United States Patent [19]

Camilleri

[11] 4,230,315

[45] Oct. 28, 1980

[54] POSITIVE TURRET INDEXING APPARATUS

[76] Inventor: Thomas M. Camilleri, 277 Avenue W, Brooklyn, N.Y. 11223

[21] Appl. No.: 973,102

[22] Filed: Dec. 26, 1978

[51] Int. Cl.[3] ..... A63D 5/00
[52] U.S. Cl. ..... 273/54 R
[58] Field of Search ..... 273/43 R, 43 A, 43 D, 273/54 R

[56] References Cited

U.S. PATENT DOCUMENTS

| | | | |
|---|---|---|---|
| 2,960,337 | 11/1960 | Johnson | 273/54 R |
| 3,076,651 | 2/1963 | Hicks | 273/54 R |
| 3,148,880 | 9/1964 | Terry | 273/54 R |

*Primary Examiner*—Anton O. Oechsle
*Attorney, Agent, or Firm*—Donald J. Perrella

[57] ABSTRACT

Pin contacting means deflect a bowling pin as it exits the cross conveyor belt so that it contacts the turret indexing paddle rather than the wires of the turret baskets.

9 Claims, 3 Drawing Figures

POSITIVE TURRET INDEXING APPARATUS

BACKGROUND OF THE INVENTION

In the Brunswick pinsetter automatic bowling machine the pins ride up a conveyor belt which feeds them to a turret which positions each pin in a basket above its respective deck chute. As the last pin reaches its position in the turret, the turret release is triggered and the pins are delivered to their respective deck chutes from whence they are positioned on the bowling alley.

As the bowling pins exit the cross conveyor belt for deposit into the turret, they are intended to fall onto a turret indexing paddle. In practice, however, the pins often contact the wires of the individual turret baskets and ricochet off the wires onto the paddle. The impact of the pins against the wires causes the wires to break. When this happens the pins can jam causing the machine to malfunction. The machine must then be taken out of service until the broken wires are replaced. Even when the wires are unbroken, when the pin ricochets off the wires it may strike the indexing paddle with insufficient force to index the turret. The turret then has to be indexed manually.

OBJECTS OF THE INVENTION

It is an object of the present invention to provide means for insuring that the bowling pins contact the turret indexing paddle directly without first contacting the wires of the basket. Another object is to provide means which eliminate the problems caused by pins striking the wires of the baskets. These and other objects of the present invention will be apparent from the folloing description.

SUMMARY OF THE INVENTION

Pin contacting means deflect a bowling pin as it exits the cross conveyor belt so that it contacts the turret indexing paddle rather than the wires of the turret baskets.

DETAILED DESCRIPTION

Figure 1:
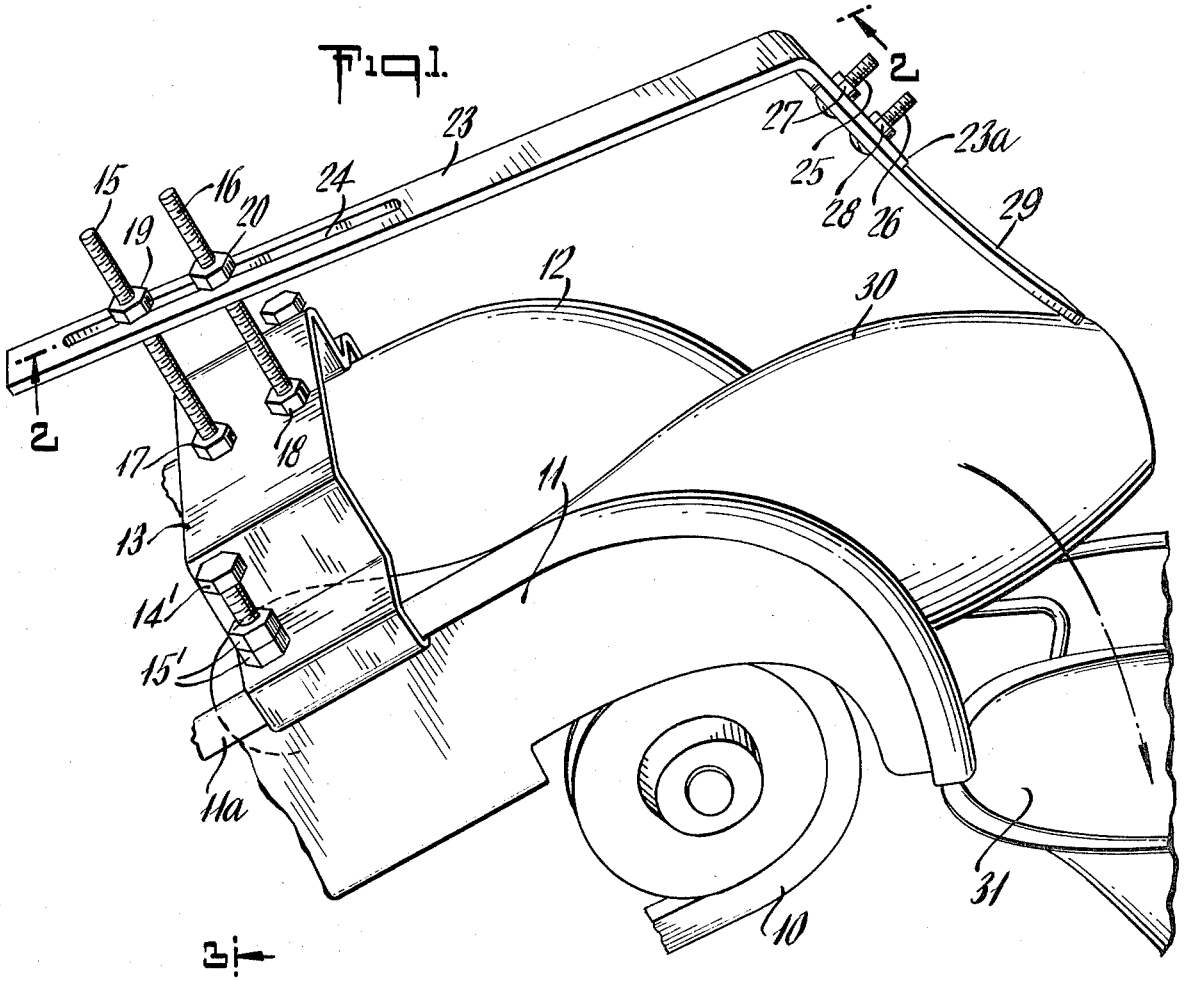
FIG. 1 is a perspective view of the positive turret indexing means of the present invention.
Figure 2:
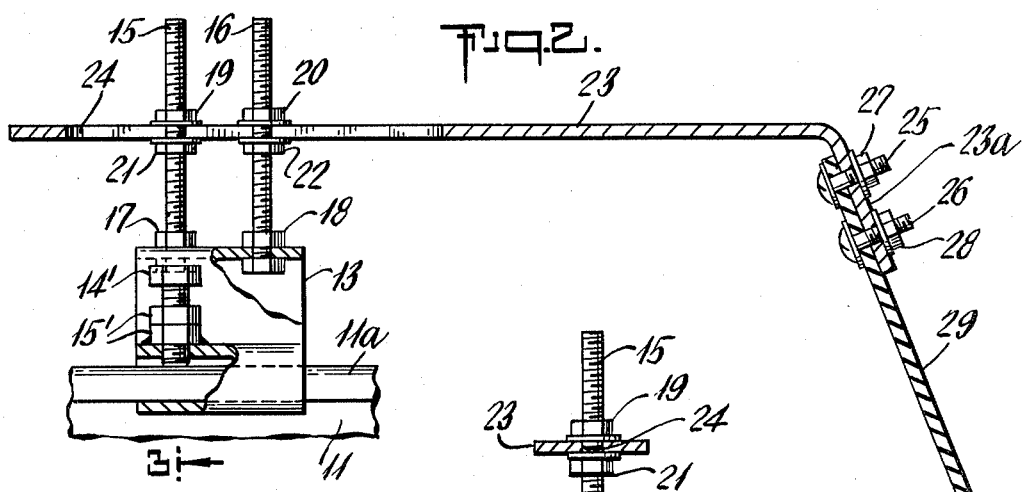
FIG. 2 is a sectional view taken along the line 2—2 of FIG. 1.
Figure 3:
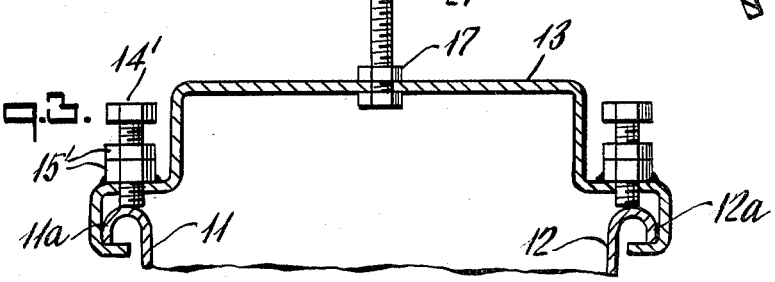
FIG. 3 is a sectional view taken along the line 3—3 of FIG. 2.

As shown in the drawings, the apparatus of the present invention comprises a mounting bracket having a central section 13 terminating at either side with a downwardly projecting section having a flanged end section adapted to fit over the curved top 11*a* and 12*a* of side walls 11 and 12. The mounting bracket is secured to rails by bolts 14' which pass through an opening in flanged end section to contact the curved top 11*a* of side wall 11. Lock nuts 15' secure bolt 14' to top 11*a*. A pair of bolts 15, 16 pass through holes in the center of section 13 and are secured by nuts 17, 18.

An arm 23 having forward or backward adjusting slot 24 is supported on bolts 15, 16 and secured by nuts 19, 21, 20 and 22. The forward end of arm 23 has downwardly projecting tip 23*a* to which pin deflector 29 is attached by bolts 25, 26 and nuts 27, 28. As a bowling pin 30 is carried to the upper end of the cross conveyor belt 10, it contacts pin deflector 29 which tips the pin down onto turret indexing paddle 31 thereby preventing the pin from failing to engage the paddle 31 correctly and damaging the wires of the turret baskets.

What is claimed is:

1. In a bowling pin setting machine, a cross conveyor belt bounded by stationary vertical side walls, and a turret indexing paddle beyond and below the exit of the conveyor belt, wherein the improvement comprises a bracket, means supporting said bracket above the conveyor belt, an arm attached to said bracket having an end extending beyond the conveyor belt exit, the arm having downwardly projecting means at said end adapted to deflect a pin exiting from said conveyor belt down onto said turret indexing paddle.

2. Apparatus according to claim 1 wherein the mounting bracket has a flanged end section adapted to be secured to one side wall.

3. Apparatus according to claim 2 wherein the mounting bracket has two flanged end sections, each end section adapted to be secured to one side wall.

4. Apparatus according to claim 1 wherein the arm is provided with means adapted to permit forward and backward movement with respect to the support means.

5. Apparatus according to claim 1 wherein the means adapted to permit forward and backward movement with respect to the support means comprise slot means.

6. Apparatus according to claim 1 wherein the arm is attached to the bracket by bolt means.

7. Apparatus according to claim 6 wherein the deflector comprises a straight member extending beyond the bent portion of the arm.

8. Apparatus according to claim 1 wherein the downwardly projecting means comprise a bent portion of the arm having a deflector attached thereto.

9. Apparatus according to claim 1 wherein the bracket is supported and mounted upon the side walls bounding the conveyor belt.

* * * * *